US005897471A

United States Patent [19]

Multanen et al.

[11] Patent Number: 5,897,471

[45] Date of Patent: Apr. 27, 1999

[54] UPPER BODY MUSCLE TONER DEVICE AND LEG AND KNEE EXERCISER

[76] Inventors: William Multanen; Paris Williams, both of 43917 Elm Ave., Lancaster, Calif. 93534

[21] Appl. No.: 09/009,052

[22] Filed: Jan. 20, 1998

[51] Int. Cl.[6] ..... A63B 21/02

[52] U.S. Cl. ..... 482/44; 422/121; 422/126

[58] Field of Search ..... 482/121, 126, 482/127, 44

[56] References Cited

U.S. PATENT DOCUMENTS

| | | | |
|---|---|---|---|
| 3,109,651 | 11/1963 | O'Donnell . | |
| 4,204,674 | 5/1980 | Ogland . | |
| 4,852,873 | 8/1989 | O'Donnell et al. | 482/127 |
| 5,004,226 | 4/1991 | Brown, Jr. | 482/127 |
| 5,026,050 | 6/1991 | Leung et al. | 482/126 |
| 5,143,057 | 9/1992 | DePasquale . | |
| 5,195,938 | 3/1993 | Robertson . | |
| 5,514,058 | 5/1996 | Buoni et al. | 482/126 |

*Primary Examiner*—Lynne A. Reichard
*Attorney, Agent, or Firm*—Michael I. Kroll

[57] ABSTRACT

A first embodiment upper body muscle toner device and leg and knee exerciser (12) comprising a U-shaped flexure member (14) and a pair of handgrips (16). Each handgrip (16) is on an opposite end of the U-shaped flexure member (14), so that a person can grasp the handgrips (16) to flex the U-shaped flexure member (24) in and out with arm power to tone up the upper body muscles and exercise the legs and knees during a workout exercise. A second embodiment upper body muscle toner device and leg and knee exerciser (12*a*) contains two different types of removable extended handgrips (16*a*) and (16*b*) on the ends of the U-shaped flexure member (14*a*). A third embodiment upper body muscle toner device and leg and knee exerciser (12*b*) consists of the U-shaped flexure member (14*b*) being a curved tube piece (50) and a pair of straight tube pieces (52) connected with two springs (54). A hanger assembly (56) can be utilized to hang the third embodiment upper body muscle toner device and leg and knee exerciser (12*b*) from a support shaft (58) when not in use.

25 Claims, 15 Drawing Sheets

UPPER BODY MUSCLE TONER DEVICE AND LEG AND KNEE EXERCISER

BACKGROUND OF THE INVENTION

1. Field of the Invention

The instant invention relates generally to exercise equipment and more specifically it relates to an upper body muscle toner device and leg and knee exerciser. The upper body muscle toner device and leg and knee exerciser is a U-shaped flexure member having a pair of handgrips. A person can grasp the handgrips to flex the U-shaped flexure member in and out with arm power, to tone up the upper body muscles and exercise the legs and knees during a workout exercise.

2. Description of the Prior Art

Numerous exercise equipment have been provided in prior art. For example, U.S. Pat. Nos. 3,109,651 to Wheeler; 4,204,674 to Ogland; 5,143,057 to DePasquale and 5,195,938 to Robertson all are illustrative of such prior art. While these units may be suitable for the particular purpose to which they address, they would not be as suitable for the purposes of the present invention as heretofore described.

WHEELER, BEVERLY LYNN

RECREATION DEVICE

U.S. Pat. No. 3,109,651

In a recreation device, in combination, a circular inner loop of tubular transparent plastic is adapted to encircle a player's body. An outer loop of the tubular plastic is disposed eccentrically with respect to the inner loop and is joined to the same to form two substantially tangentially intersecting internal passages. An internally disposed ball is adapted to be directed alternatively throughout the two passages in pre-selected order under control of movements applied to the joined loops by the player.

OGLAND, THOMAS W.

POCKET SIZE, ADJUSTABLE EXERCISER

U.S. Pat. No. 4,204,674

A pocket-size, adjustable exerciser used for performing tension exercises. The invention comprising a freestanding, elongated member and adjustable looped end means for gripping the exerciser. The length of the end means is selectively adjustable, depending on the exercise to be performed and on the size of the person using the exerciser.

DePASQUALE, LOUIS J.

OVERPRESSURE DEVICE FOR MECHANICAL TREATMENT OF THE HUMAN BODY

U.S. Pat. No. 5,143,057

A device for applying localized forces to portions of the human anatomy, such as the spine, to treat physical conditions and disorders requiring some degree of mechanical manipulation of therapy, comprising an outer roll of pliable material having a resiliently deformable surface for comfortably but firmly engaging a body portion of a user in a surrounding manner. A supporting member extends within the roll and is of a stiffer but bendable material, so as to provide support for and wrappingly press the roll against the effected body portion. Drawing members extend from the ends of the supporting member and are grippable by the user for applying the required force to the supporting member to press the roll against the body portion. The drawing members may be handgrips or a belt member to tie the roll about the user's waist. Additionally, a stabilizing member may be attached between the roll and belt member, to extend between the user's legs for preventing the roll from riding up too far on the user's back, when pressure is being applied by pulling on the drawing members.

ROBERTSON, KEVIN R.

ABDOMINAL EXERCISING DEVICE

U.S. Pat. No. 5,195,938

An abdominal exercising device having two identical structures, each comprised of a rigid member, pressure pad and handle, are connected by an adjustable strap adapted to partially encircle the users abdominal area. After the user obtains the standard sit-up crunch or leg lift position, the adjustable strap is placed under the lower back while the two structures are brought across the abdominal area with each structures pressure pad contacting the users abdominal muscles. The user holds both handles and applies pressure to the abdominal muscles by simultaneously pulling the handles in toward the torso while performing the exercise movement.

SUMMARY OF THE INVENTION

A primary object of the present invention is to provide an upper body muscle toner device and leg and knee exerciser that will overcome the shortcomings of the prior art devices.

Another object is to provide an upper body muscle toner device and leg and knee exerciser that is a U-shaped flexure member having a pair of handgrips, so that a person can grasp the handgrips to flex the U-shaped flexure member in and out with arm power to tone up the upper body muscles during a workout exercise.

An additional object is to provide an upper body muscle toner device and leg and knee exerciser that is extremely lightweight, compact, totally portable and environmentally friendly, since no batteries or electrical power is required to operate it.

A further object is to provide an upper body muscle toner device and leg and knee exerciser that is simple and easy to use.

A still further object is to provide an upper body muscle toner device and leg and knee exerciser that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figures 1, 2, 3:
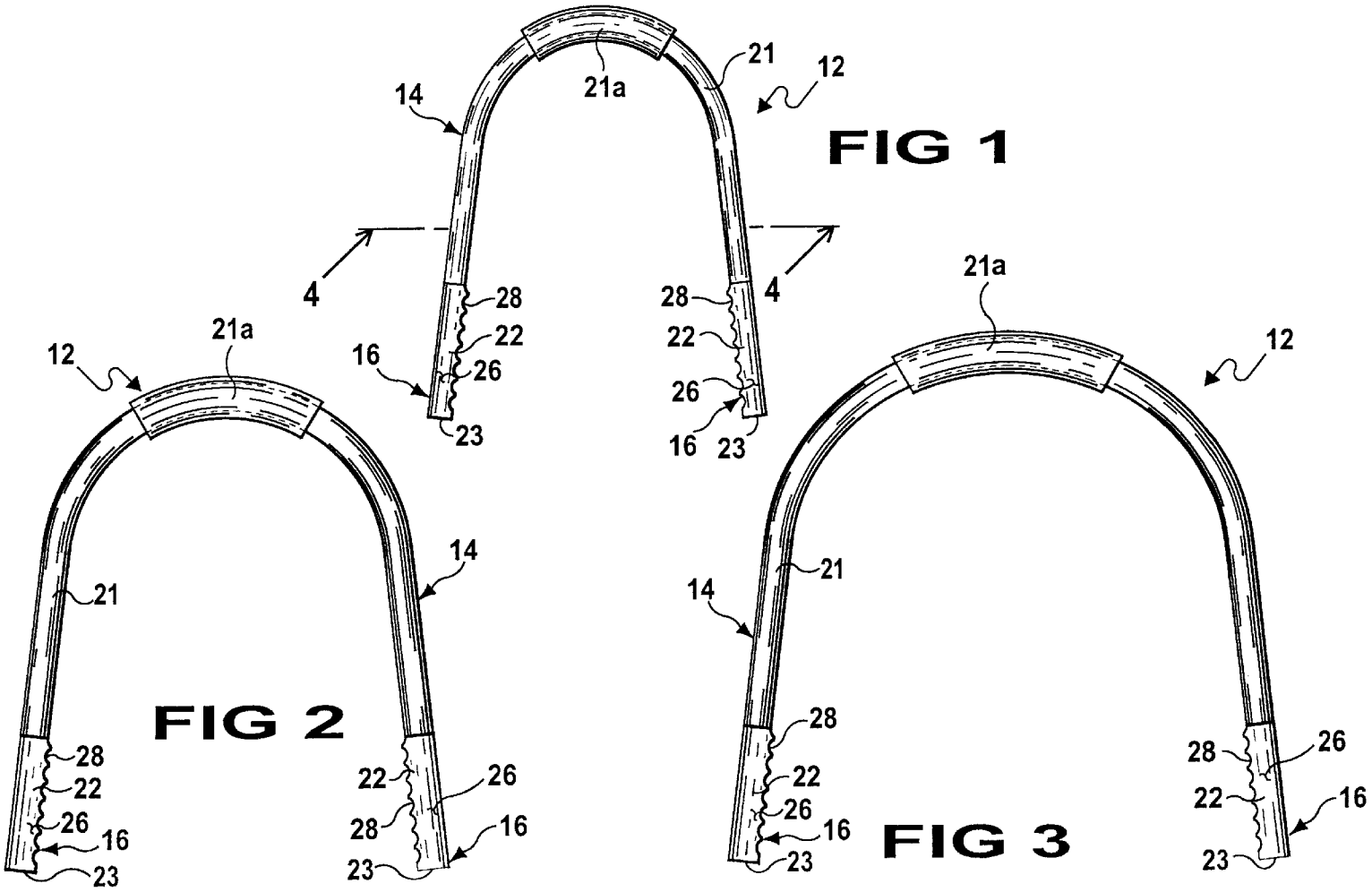
FIG. 1 is an elevational view of a first embodiment of the present invention being a small size unit.
FIG. 2 is an elevational view similar to FIG. 1, of the first embodiment being a medium size unit.
FIG. 3 is an elevational view similar to FIG. 2, of the first embodiment being a large size unit.

Turning now descriptively to the drawings, in which similar reference characters denote similar elements throughout the several views, FIGS. 1 through 15 illustrate the present invention being four different embodiments of an upper body muscle toner device and leg and knee exerciser being 12, 12*a*, 12*b* and 12*c*. With regard to the reference numerals used, the following numbering is used throughout the various drawing figures.

12 first embodiment upper body muscle toner device and leg and knee exerciser

12*a* second embodiment upper body muscle toner device and leg and knee exerciser

12*b* third embodiment upper body muscle toner device and leg and knee exerciser

12*c* fourth embodiment upper body muscle toner device and leg and knee exerciser

14 U-shaped flexure member of 12

14*a* U-shaped flexure member of 12*a*

14*b* U-shaped flexure member of 12*b*

14*c* U-shaped flexure member of 12*c*

16 handgrip on end of 18, 52 and 66

16*a* first removable extended handgrip on end of 14*a*

16*b* second removable extended handgrip on end of 14*a*

18 elongate tube for 14

18*a* elongate tube for 14*a*

20 polyvinyl chloride material of 14, l4*a*, 36, 50, 52, 64 and 66

20*a* fiberglass material of 14, 14*a*, 36, 50, 52, 64 and 66

20*b* flexible metal material of 14, 14*a* 36, 50, 52, 64 and 66

21 foam rubber insulation pipe over 18, 18*a*, 50 and 66

21*a* foam rubber neck brace over 21

22 sleeve for 16

23 closed end of 22

24 hard rubber material of 16, 29 and 40

26 textured external surface on 16

28 finger indentation on 16

29 elongate shaft of 16*a*

30 textured external surface on 29

30*a* lower end of 29

31 connector of 16*a*

32 threaded shank of 31

33 collar of 31

34 upper end of 29

35 bore in 18*a*

36 tube extension of 16*b*

38 threaded shank of 36

40 short shaft of 16*b*

42 textured external surface on 40

43 lower end of 40

44 collar on 40

45 upper end of 40

46 adhesive on 45

48 bore in 36

50 curved tube piece of 14*b*

52 straight tube piece of 14*b*

54 spring of 14*b*

56 hanger assembly of 12*b*

58 support shaft

60 metal of 54 and 56

62 plastic of 54 and 56

64 coil tension tube piece of 14*c*

66 straight tube piece of 14*c*

The first embodiment upper body muscle toner device and leg and knee exerciser 12 is shown in FIGS. 1 through 5 and comprises a U-shaped flexure member 14 with a pair of handgrips 16. Each handgrip 16 is on an opposite end of the U-shaped flexure member 14, so that a person can grasp the handgrips 16 to flex the U-shaped flexure member 14 in and out with arm power to tone up the upper body muscles and exercise the legs and knees during a workout exercise.

Figure 4:
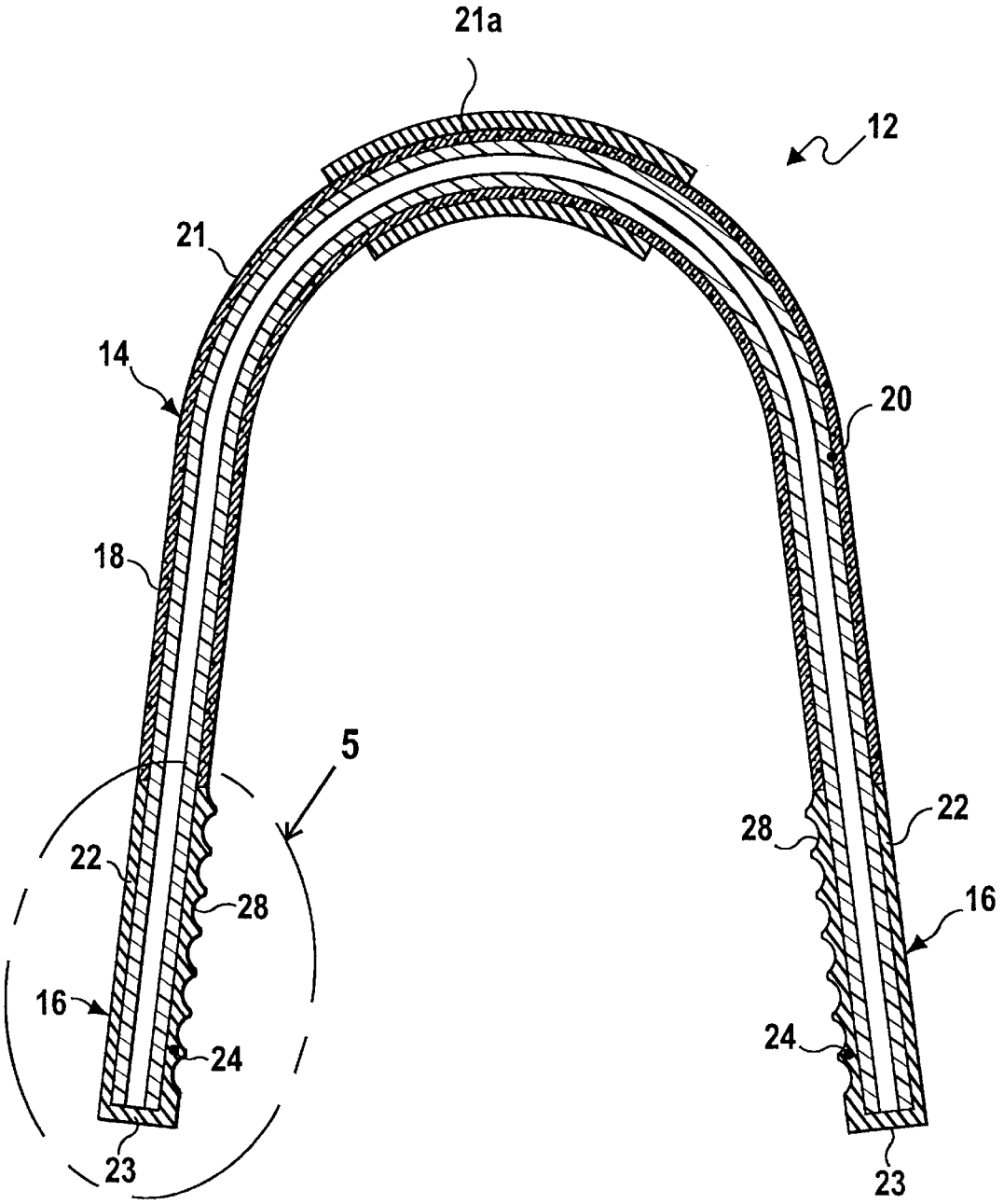
FIG. 4 is an enlarged cross sectional view taken along line 4—4 in FIG. 1, showing the elongate tube of the U-shaped flexure member made of a polyvinyl chloride material.
Figure 4A:
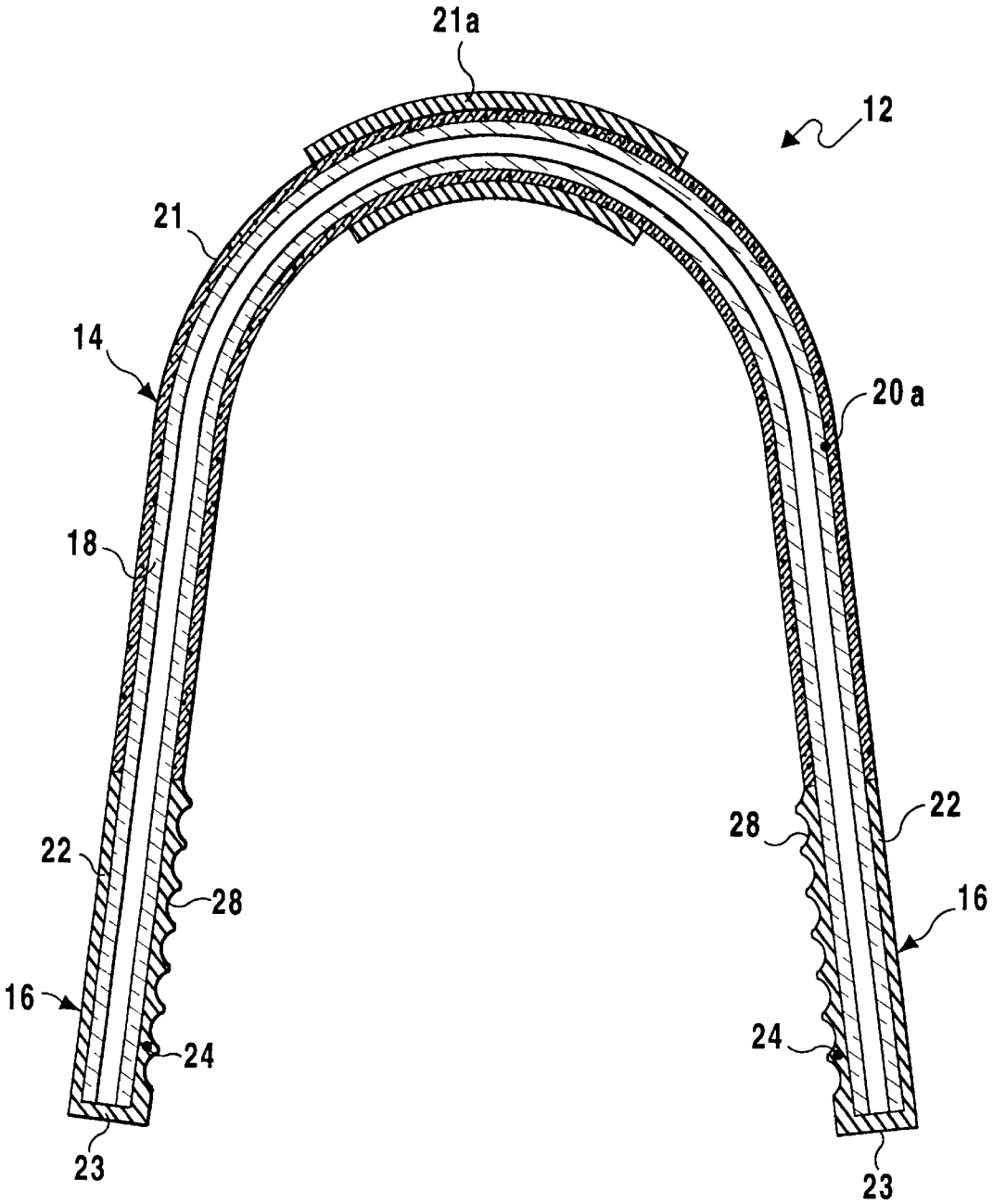
FIG. 4A is an enlarged cross sectional view similar to FIG. 4, showing the elongate tube of the U-shaped flexure member made of a fiberglass material.
Figure 4B:
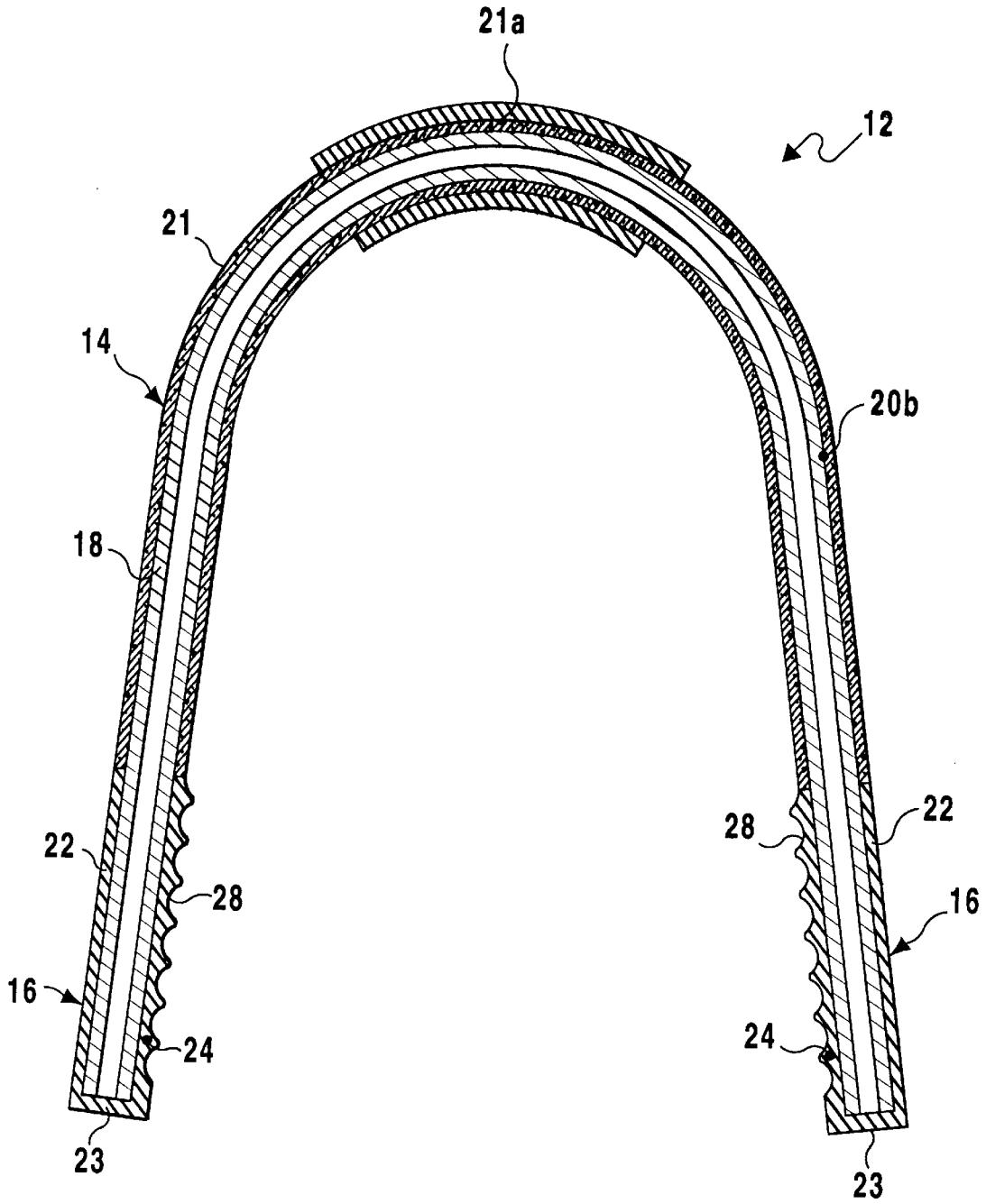
FIG. 4B is an enlarged cross sectional view similar to FIG. 4A, showing the elongate tube of the U-shaped flexure member made of a flexible metal material.
Figure 5:
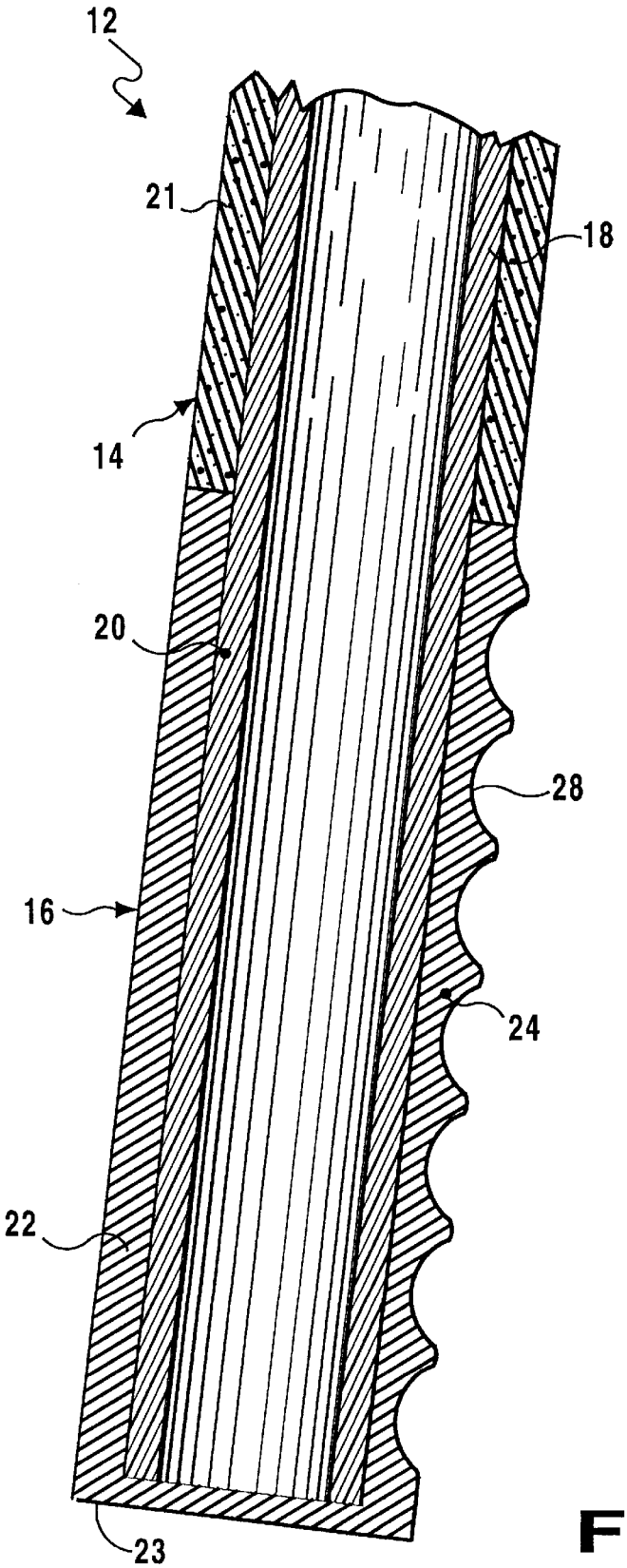
FIG. 5 is a further enlarged cross sectional view of an area in FIG. 4, as indicated by arrow 5, showing the handgrip on one and of the U-shaped flexure member in greater detail.
Figure 6:
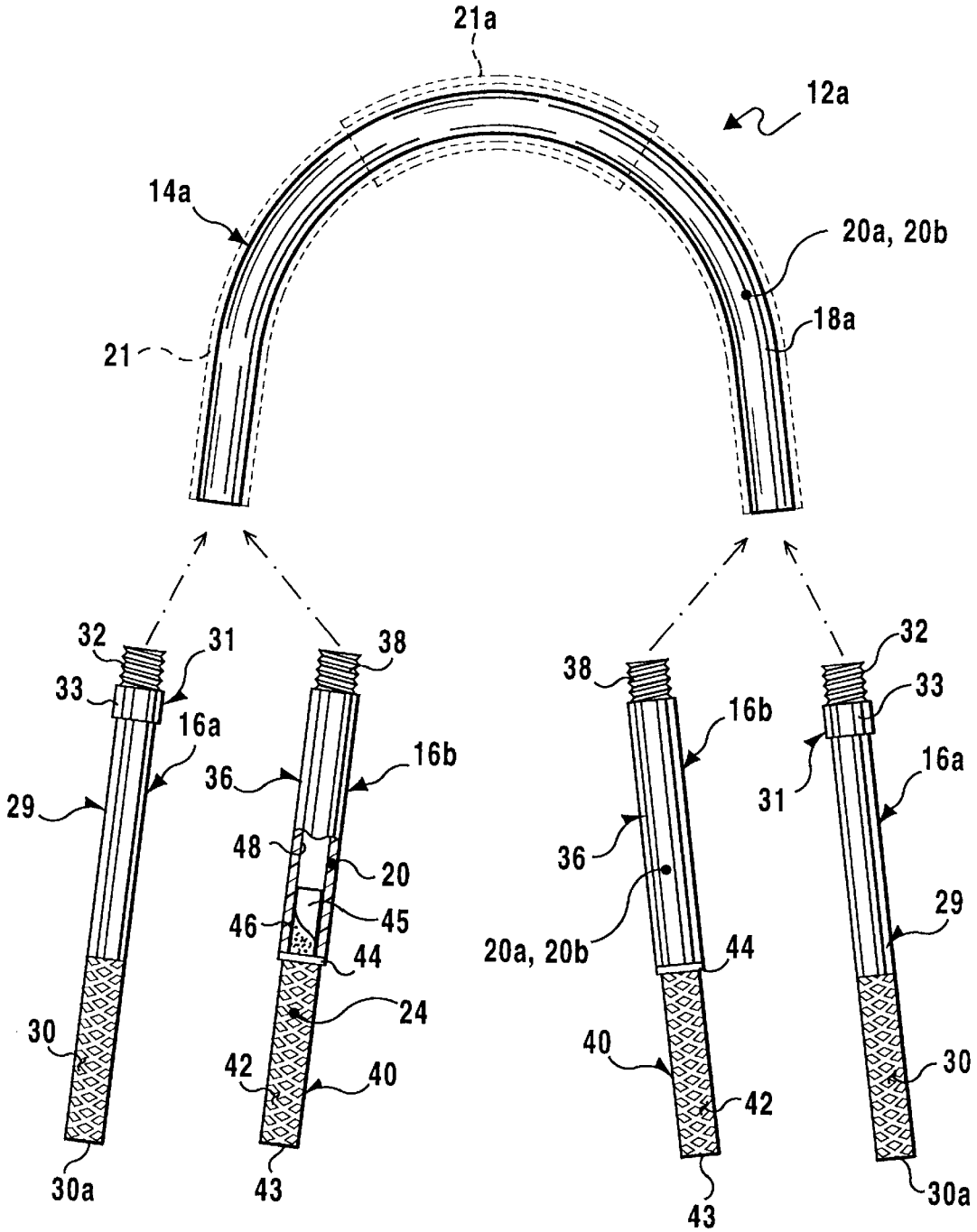
FIG. 6 is an exploded elevational view of a second embodiment of the present invention being a small size unit and having two different types of attachable handgrips.
Figure 7:
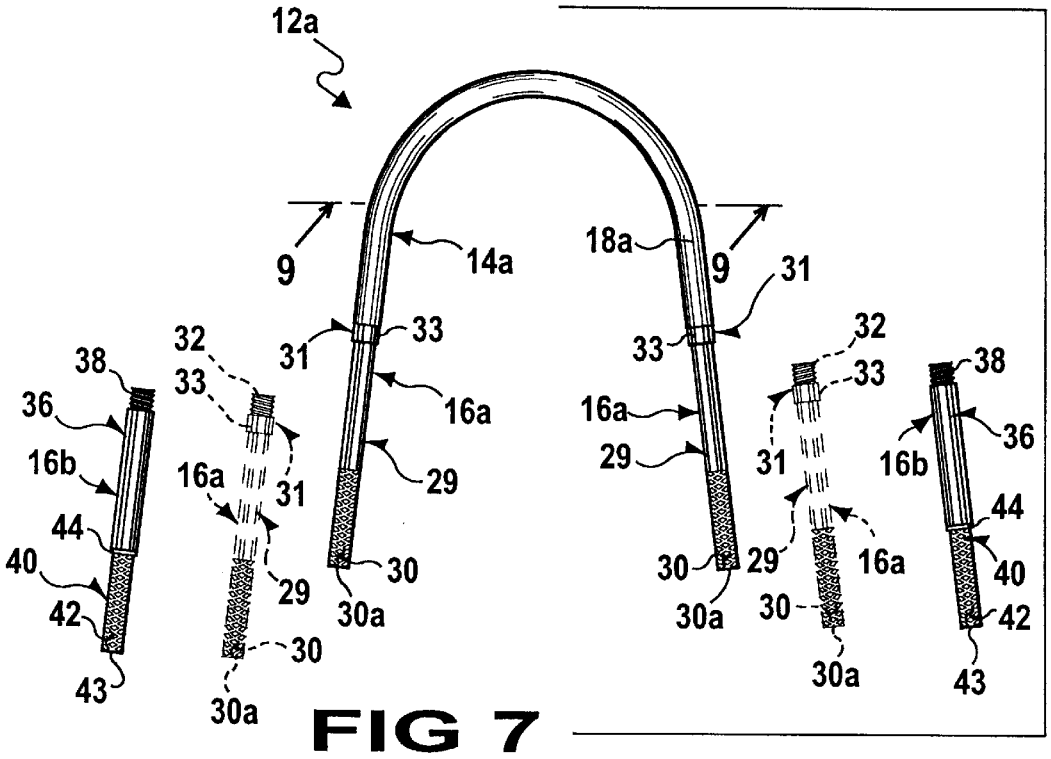
FIG. 7 is an assembled elevational view similar to FIG. 6, with the first type of handgrips assembled thereto and in phantom disassembled, while the second type of handgrips are shown disassembled.
Figure 8:
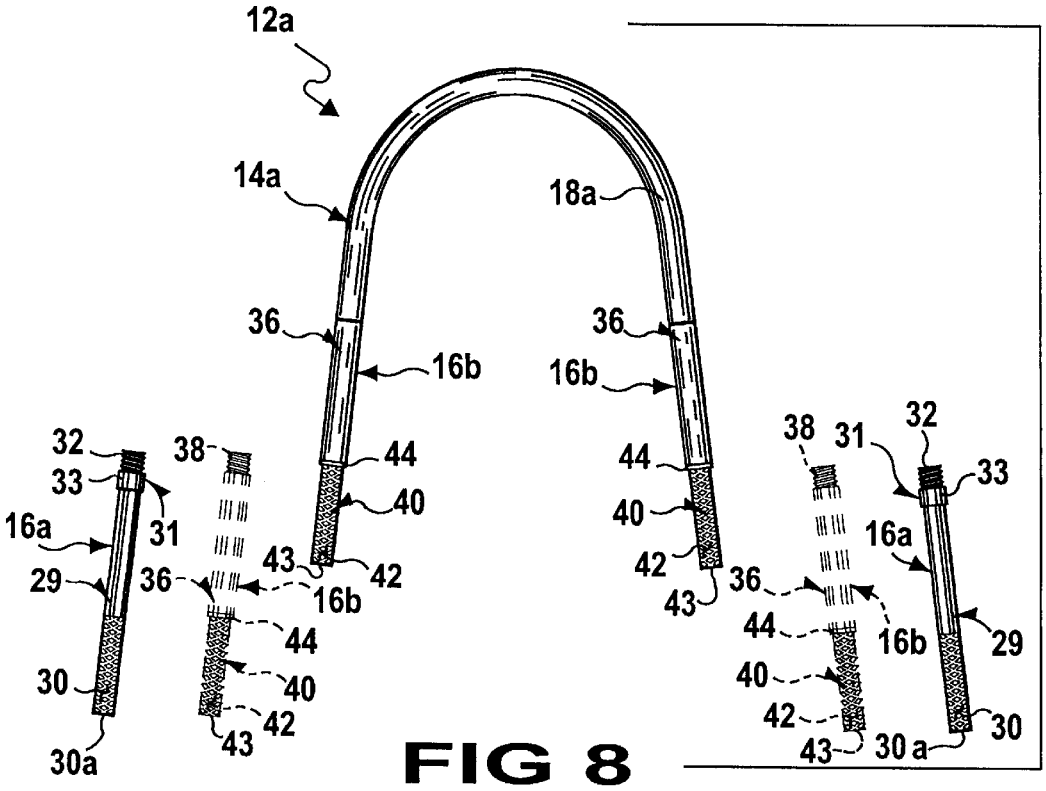
FIG. 8 is an assembled elevational view similar to FIG. 7, with the second type of handgrips assembled thereto and in phantom disassembled, while the first type of handgrips are shown disassembled.
Figure 9:
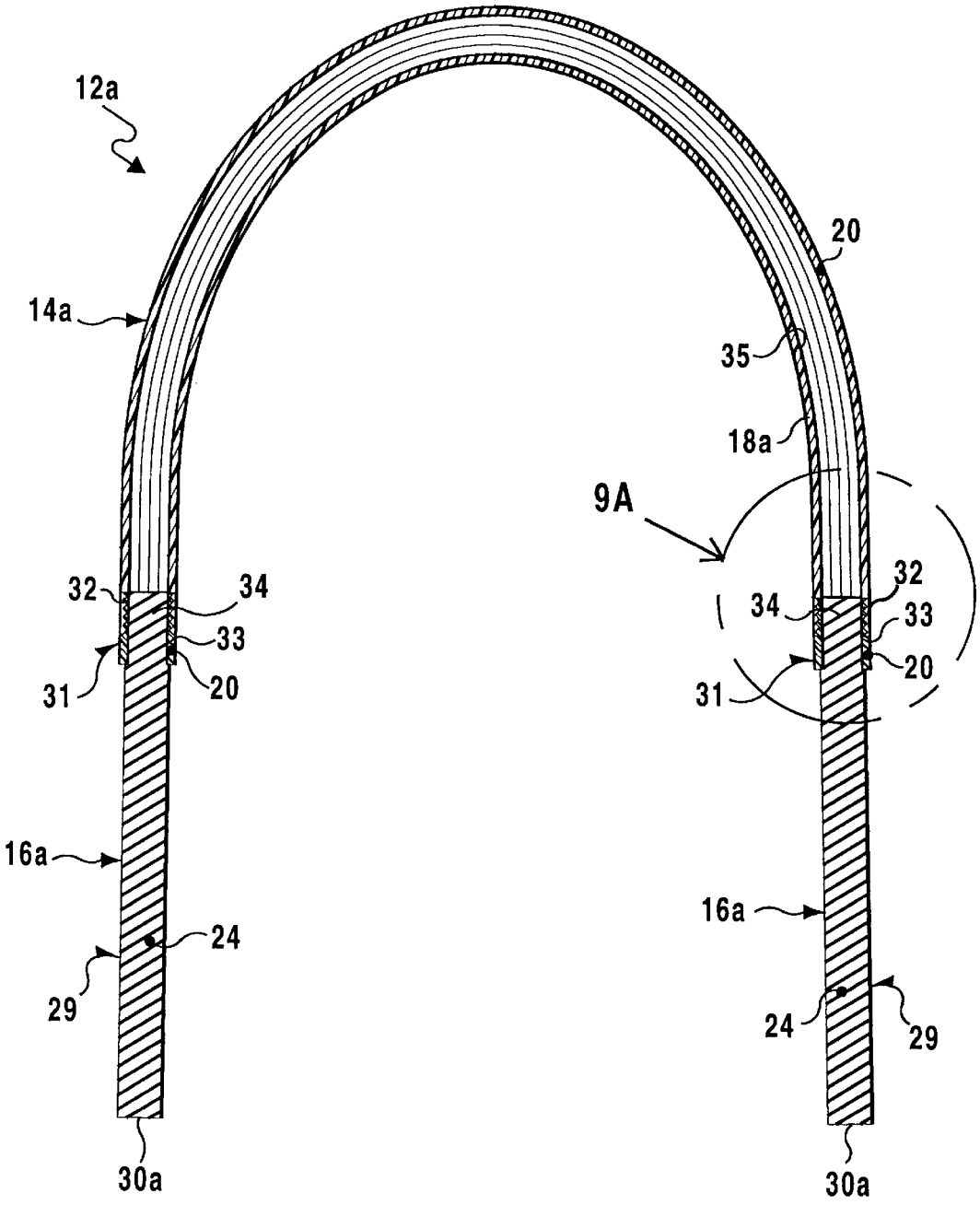
FIG. 9 is an enlarged cross sectional view taken along line 9—9 in FIG. 7.
Figure 9A:
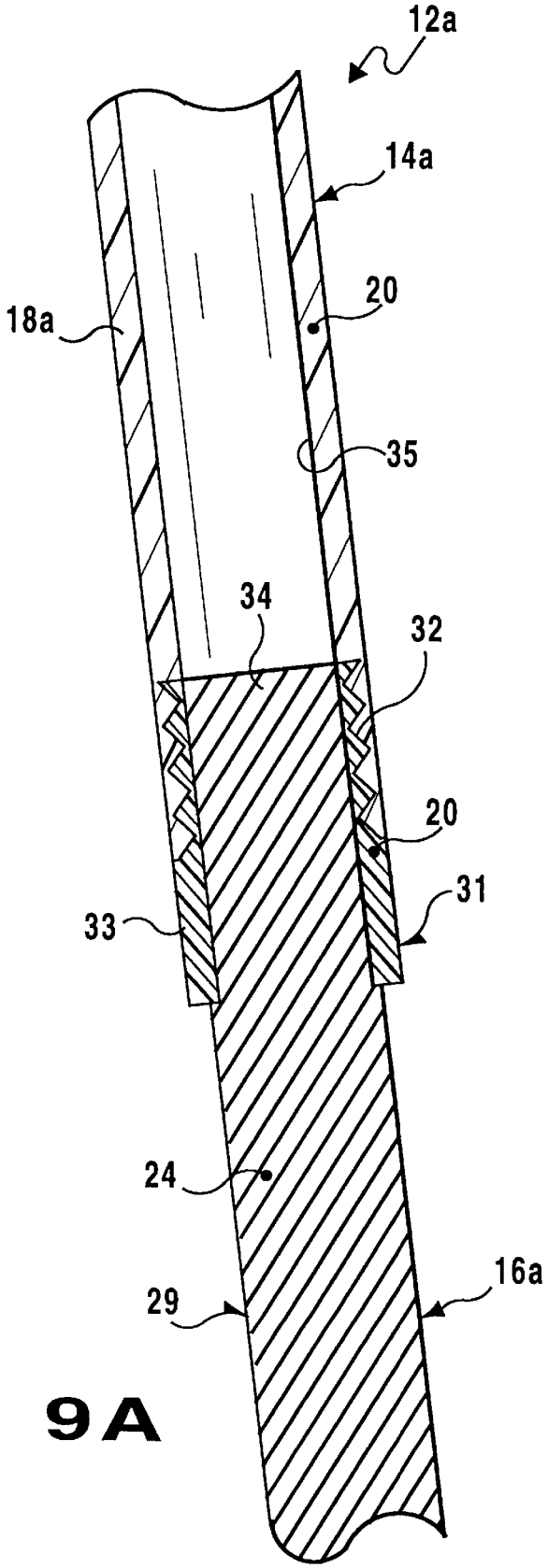
FIG. 9A is a further enlarged cross sectional view of an area in FIG. 9, as indicated by arrow 9A, showing the first type of handgrip on one end of the U-shaped flexure member in greater detail.
Figure 10:
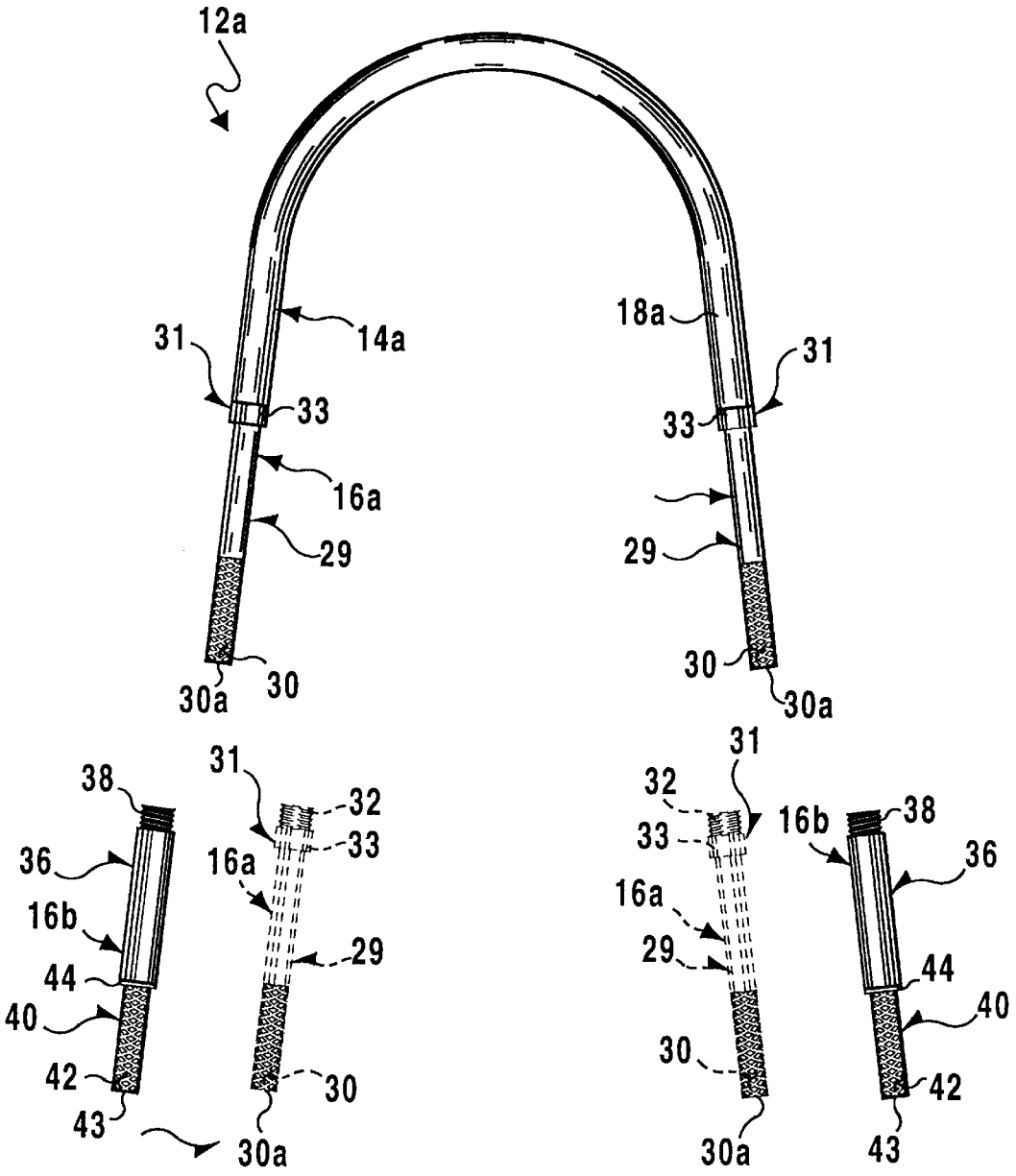
FIG. 10 is an assembled elevational view similar to FIG. 7, of the second embodiment being a medium size unit.
Figure 11:
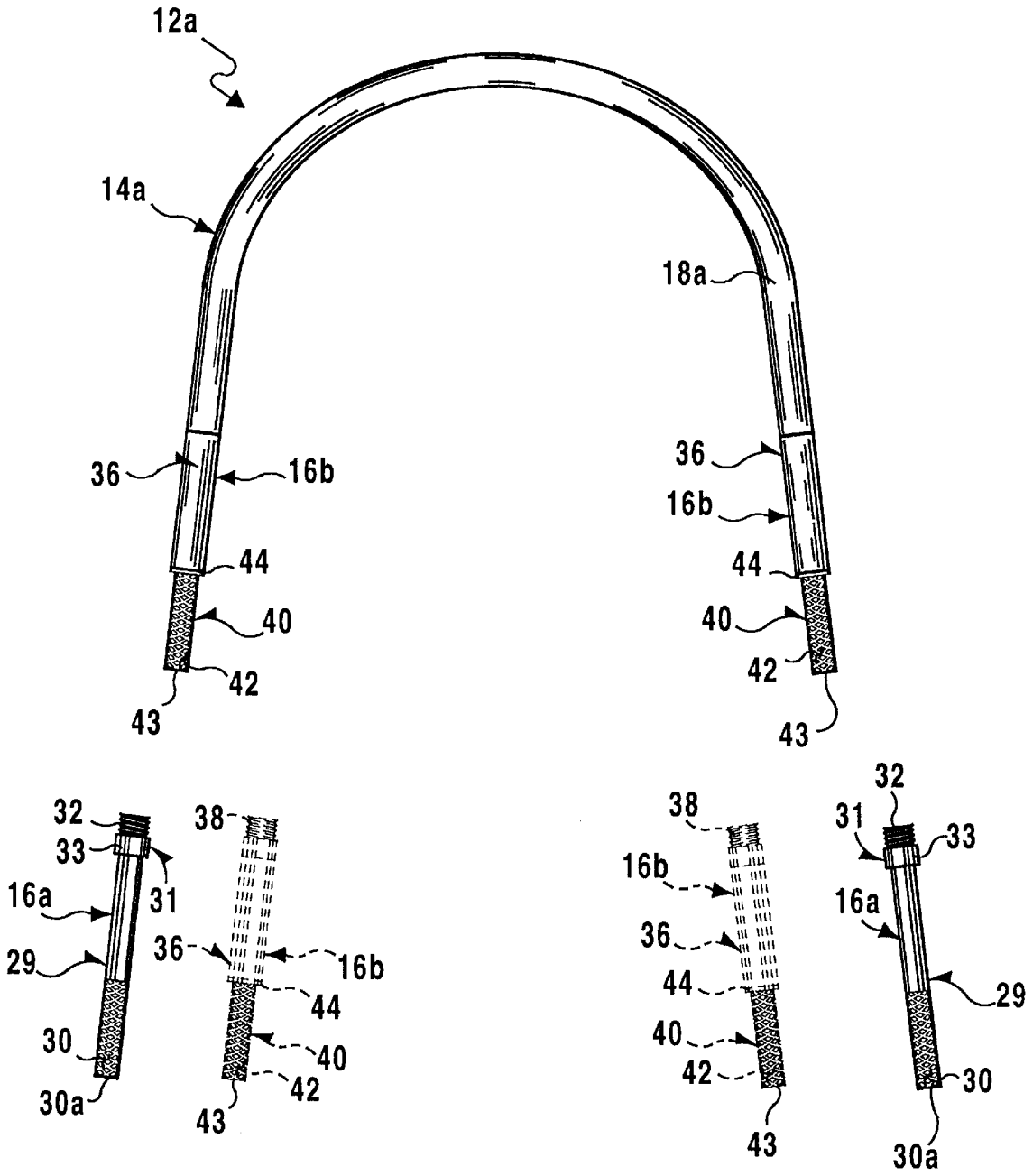
FIG. 11 is an assembled elevational view similar to FIG. 8, of the second embodiment being a large size unit.

The U-shaped flexure member 14 is an elongate tube 18. The U-shaped flexure member 14 can be fabricated out of a polyvinyl chloride material 20, as shown in FIG. 4, a fiberglass material 20*a*, as shown in FIG. 4A, or a flexible metal material 20*b*, as shown in FIG. 4B.

The U-shaped flexure member 14 can be made in various lengths, to accommodate persons of different sizes. For example, in FIGS. 1, and 4 to 4B, the length of the U-shaped flexure member 14 can be approximately forty eight inches long making the first embodiment upper body muscle toner device and leg and knee exerciser 12 a small size unit. In FIG. 2 the length of the U-shaped flexure member 14 can be approximately fifty four inches long, making the first embodiment upper body muscle toner device and leg and knee exerciser 12 a medium size unit. In FIG. 3, the length of the U-shaped flexure member 14 can be approximately sixty inches long, making the first embodiment upper body muscle toner device and leg and knee exerciser 12 a large size unit. The upper body muscle toner device and leg and knee exerciser 12 can further include a foam rubber insulation pipe 21 over the elongate tube 18, so as to cushion the elongate tube 18, when the person exercises. A foam rubber neck brace 21*a* can be centrally located over the foam rubber insulation pipe, so as to comfortably support the neck of the person, when the person does neck and shoulder exercises.

Each handgrip 16 is a sleeve 22, having a closed end 23 that slips onto a respective end of the U-shaped flexure member 14. Each handgrip 16 is fabricated out of a hard rubber material 24. Each handgrip 16 includes a textured external surface 26, so as to enhance holding thereof and prevent slippage of the hands of the person grasping the handgrips 16. Each handgrip 16 has a plurality of finger indentations 28 formed therealong, so that the person can move their hands further up the handgrips 16 to increase difficulty in the exercise being performed.

The second embodiment upper body muscle toner device and leg and knee exerciser 12*a* is shown in FIGS. 6 through 11. Two different types of removable handgrips 16*a*, 16*b* are provided. Each handgrip 16*a* is extended and includes an elongate shaft 29 having a textured external surface 30 on a lower end 30*a*, so as to enhance holding thereof and prevent slippage of the hands of the person grasping said handgrips 16*a*. A connector 31 having a threaded shank 32 with a collar 33 is force fit onto an upper end 34 of the elongate shaft 29. The threaded shank 32 can be threaded within one end of a bore 35 within the elongate tube 18*a* of the U-shaped flexure member 14*a* up to the collar 33, which will prevent the handgrip 16*a* from dislodging therefrom. The elongate shaft 29 can be fabricated out of the hard rubber material 24, while the collar 33 can be fabricated out of the polyvinyl chloride material 20.

Each handgrip 16*b* is also extended and consists of a tube extension 36 having a threaded shank 38. The threaded shank 38 can be threaded within the bore 35 at one end of the elongate tube 18*a* of the U-shaped flexure member 14*a*, which will prevent the tube extension 36 from dislodging therefrom. A short shaft 40 has a textured external surface 42 on a lower end 43, so as to enhance holding thereof and prevent slippage of the hands of the person grasping the handgrips 16*b*. A collar 44 is formed on the short shaft 40 and is set back from an upper end 45. Adhesive 46 is applied onto the upper end 45 of the short shaft 40. When the upper end 45 of the short shaft 40 is inserted into one end of a bore 48 within the tube extension 36, the adhesive 46 will prevent the short shaft 40 from dislodging therefrom. The short shaft 40 can be fabricated out of the hard rubber material 24.

The second embodiment upper body muscle toner device and leg and knee exerciser 12*a* can also come in the small, medium and large size units as the first embodiment upper body muscle toner device and leg and knee exerciser 12. The U-shaped flexure member 14*a* can also be fabricated out of the same materials as the U-shaped flexure member 14, which is polyvinyl chloride material 20, fiberglass material 20*a* and flexible metal material 20*b*. The foam rubber insulation pipe 21 and the foam rubber neck brace 21*a* can also be placed over the elongate tube 18*a*, as shown in phantom in FIG. 6. The tube extension 36 can also be fabricated out of the same materials as the U-shaped flexure member 14*a*, which is polyvinyl chloride material 20, fiberglass material 20*a* and flexible metal material 20*b*.

Figure 12:
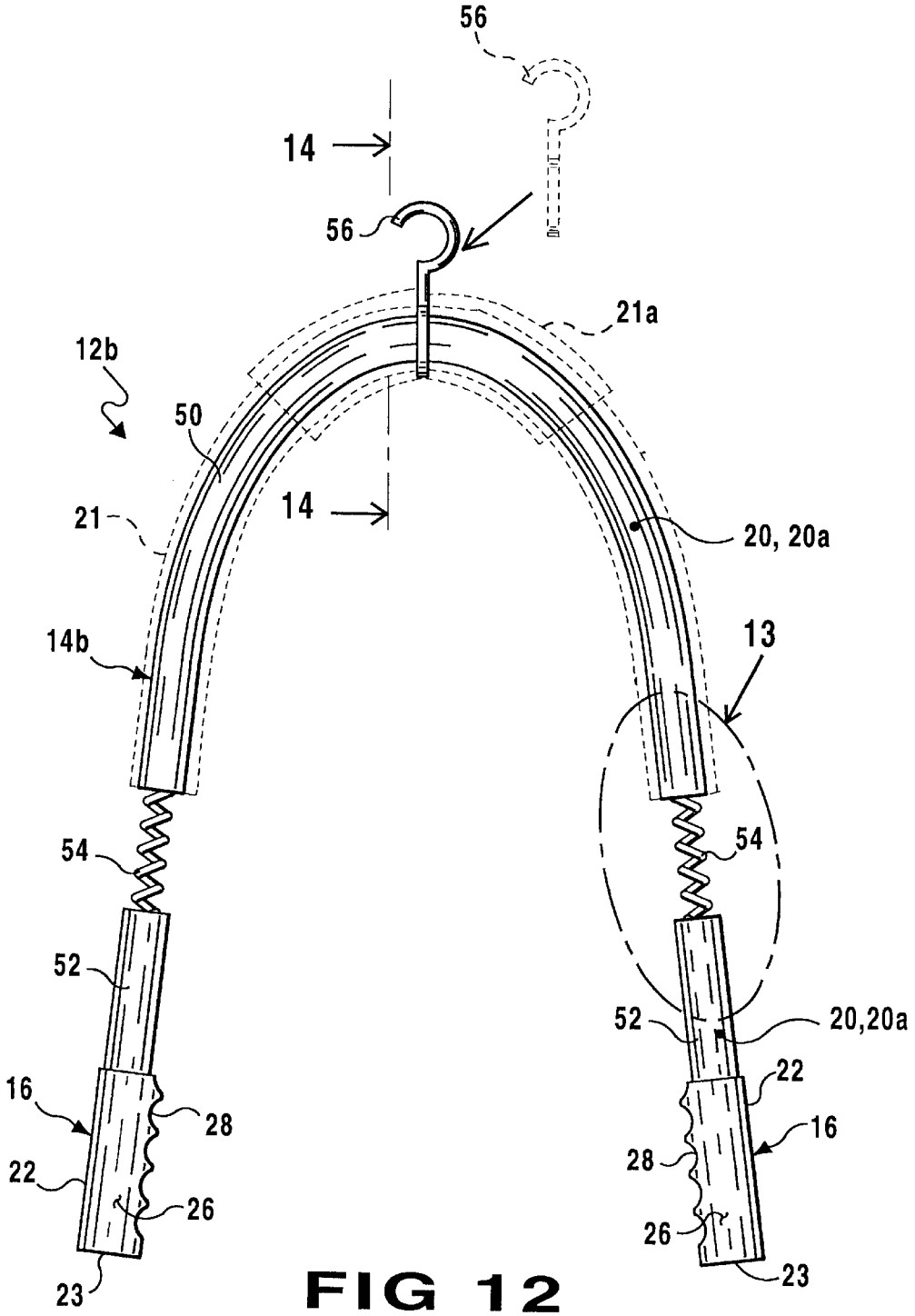
FIG. 12 is an elevational view of a third embodiment of the present invention, showing the U-shaped flexure member being of three tube pieces connected with two springs.
Figure 13:
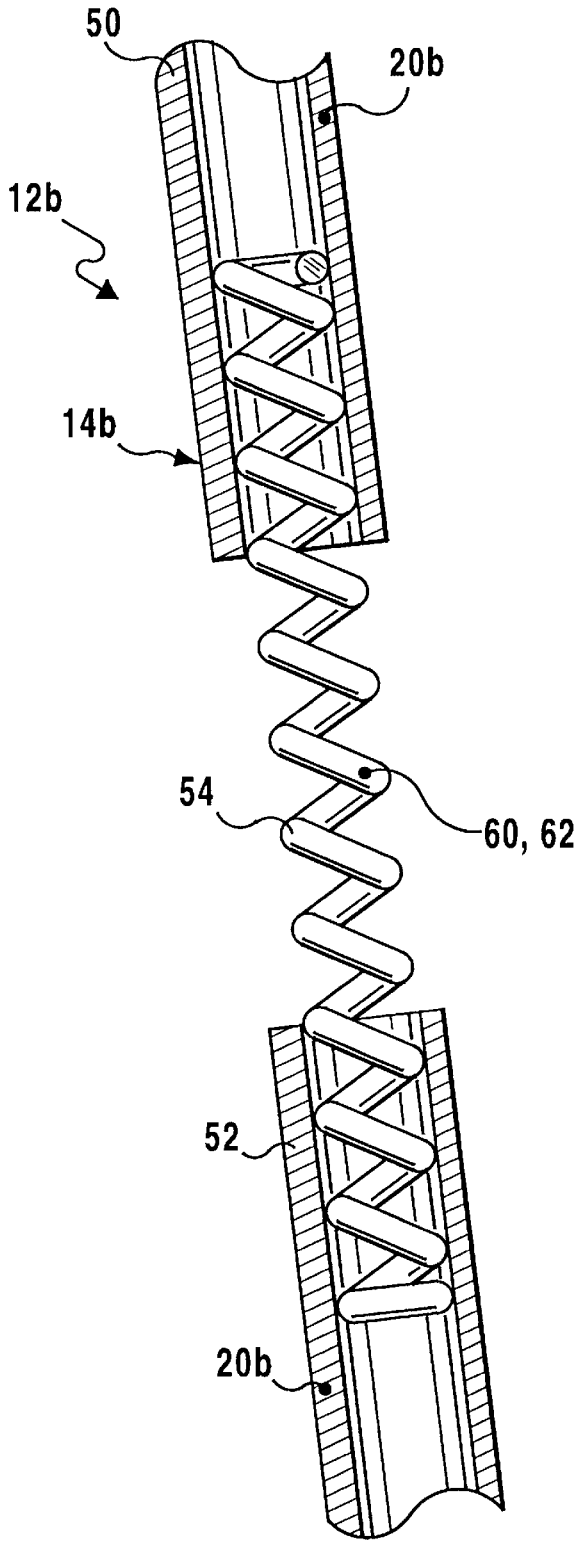
FIG. 13 is an enlarged cross sectional view of an area in FIG. 12 as indicated by arrow 13, showing one of the springs connected between two of the tube pieces in greater detail.
Figure 14:
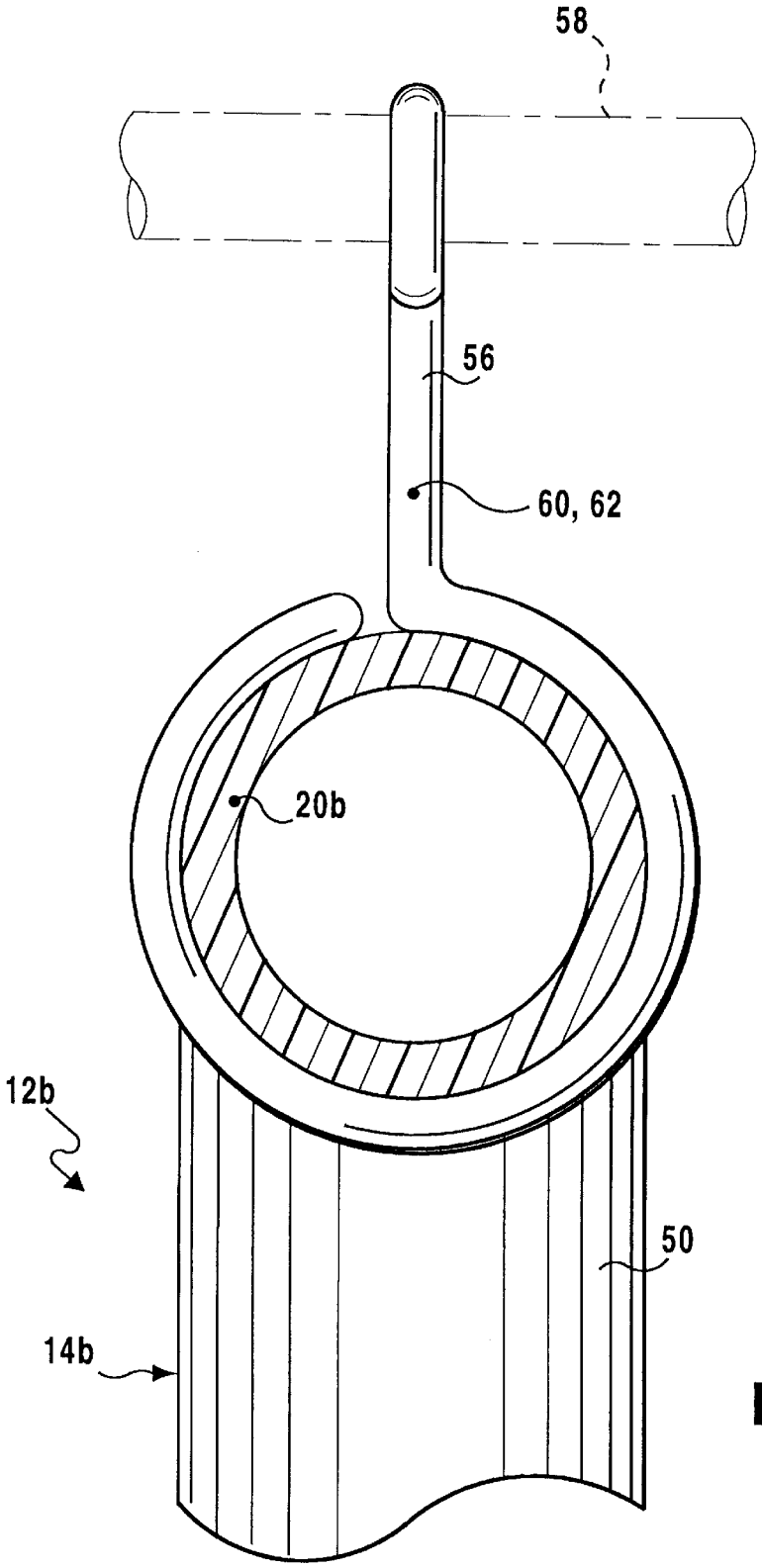
FIG. 14 is an enlarged cross sectional view taken along line 14—14 in FIG. 12, showing the hanger assembly in greater detail.

The third embodiment upper body muscle toner device and leg and knee exerciser 12*b*, is shown in FIGS. 12 through 14. The U-shaped flexure member 14*b* includes a curved tube piece 50, a pair of straight tube pieces 52 and a pair of springs 54. Each spring 54 extends between one end of the curved tube piece 50 and one end of one straight tube piece 52.

A hanger assembly 56 is attached to the center of the curved tube piece 50. The hanger assembly 56 can be utilized, to hang the third embodiment upper body muscle toner device and leg and knee exerciser 12*b* from a support shaft 58 when not in use.

The third embodiment upper body muscle toner device and leg and knee exerciser 12*b* can also come in the small, medium and large size units, as the first and second embodiment upper body muscle toner devices and leg and knee exercisers 12 and 12*a*. The curved tube piece 50 and the pair of straight tube pieces 52 of the U-shaped flexure member 14*b* can also be fabricated out of the same material as the U-shaped flexure members 14 and 14*a*, which is polyvinyl chloride material 20, fiberglass material 20*a* and flexible metal material 20*b*.

The pair of springs 54 and the hook assembly 56 can be fabricated out of a durable strong material, such as metal or plastic 62. The foam rubber insulation pipe 21 and the foam rubber neck brace 21*a*, can also be placed over the curved tube piece 50. Each handgrip 16 can be placed over a free end of each straight tube piece 52 of the U-shaped flexure member 14*b*, as shown in FIG. 12.

Figure 15:
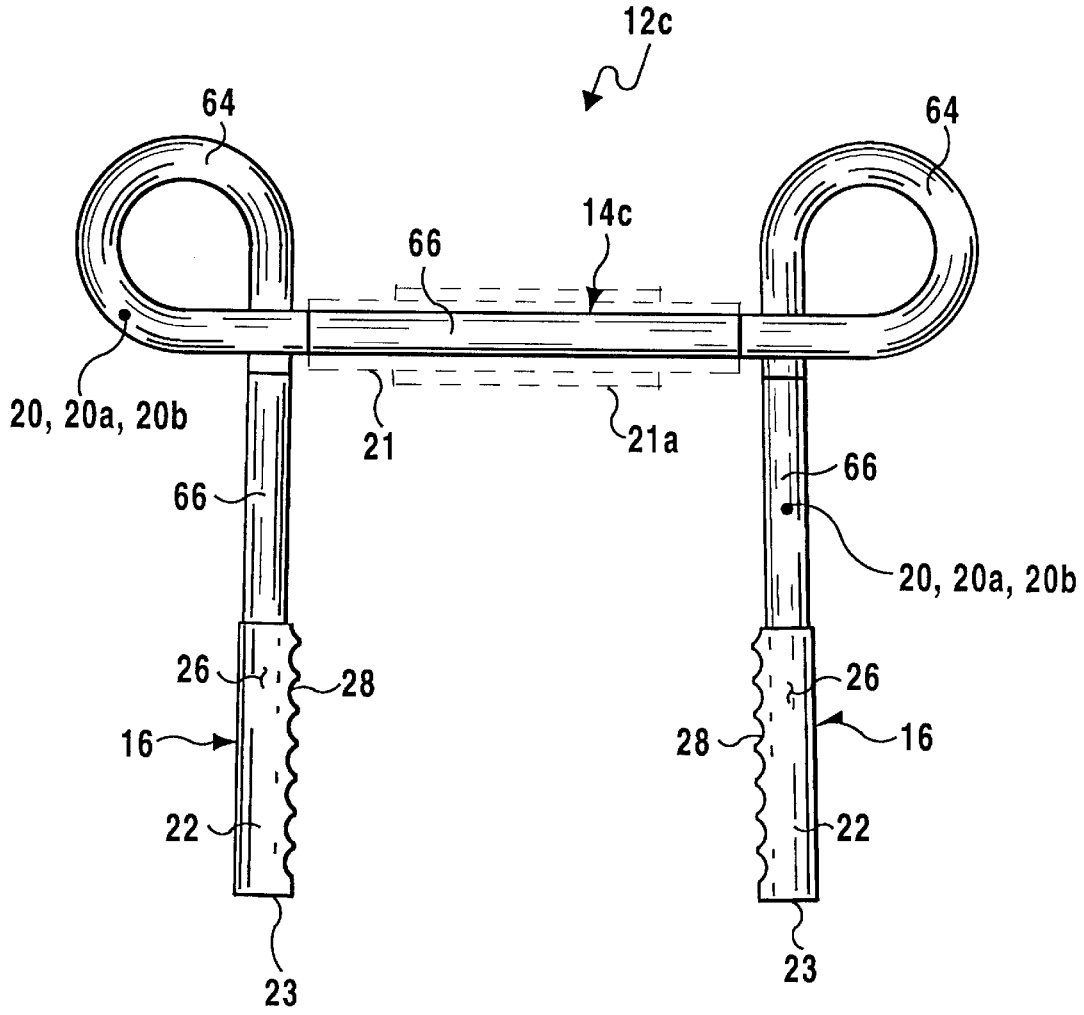
FIG. 15 is an elevational view of a fourth embodiment of the present invention.

The fourth embodiment upper body muscle toner device and leg and knee exerciser 12*c* is shown in FIG. 15. The U-shaped flexure member 14*c* consists of a pair of coil tension tube pieces 64. Three straight tube pieces 66 interconnect with the coil tension tube pieces 64.

The fourth embodiment upper body muscle toner device and leg and knee exerciser 12*c* can also come in the small, medium and large size. Units, as the firsts second and third embodiment upper body muscle toner devices and leg and knee exercisers 12, 12*a* and 12*b*. The coil tension tube pieces 64 and the three straight tube pieces 66 of the U-shaped flexure member 14*c* can also be fabricated out of the same materials as the U-shaped flexure members 14, 14*a* and 14*b*, which is polyvinyl chloride material 20, fiberglass material 20*a* and flexible metal material 20*b*. The foam rubber insulation pipe 21 and the foam rubber neck brace 21*a* can also be placed over the middle straight tube piece 66, not shown in FIG. 15. Each handgrip 16 can be placed over a free end of each of two straight tube pieces 66, as shown in FIG. 15.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An upper body muscle toner device and leg and knee exerciser comprising:

a) a U-shaped flexure member, said U-shaped flexure member being an elongate tube: and b) a pair of handgrips, each handgrip is on an opposite end of said U-shaped flexure member, so that a person can grasp said handgrips to flex said U-shaped flexure member in and out with arm power to tone up the upper body muscles and exercise the legs and knees during a workout exercise, wherein each said handgrip is extended and includes:

i) an elongate shaft having a textured external surface on a lower end, so as to enhance holding thereof and prevent slippage of the hands of the person grasping said handgrips; and ii) a connector having an externally threadded shank with a collar force fit onto an upper end of said elongate shaft, so that said externally threaded shank can be threaded within one end of a bore within said elongate tube up to said collar, which will prevent said handgrip from dislodging therefrom.

2. An upper body muscle toner device and leg and knee exerciser as recited in claim 1, wherein said U-shaped flexure member is fabricated out of a polyvinyl chloride material.

3. An upper body muscle toner device and leg and knee exerciser as recited in claim 2, wherein said U-shaped flexure member includes:

a) a pair of coil tension tube pieces; and b) first, second and third straight tube pieces which interconnect with said pair of coil tension tube pieces, wherein said first straight tube piece is connected to extend from a first end of a first one of said pair of coil tension tube pieces, said second straight tube piece is connected between a second end of said first one of said pair of coil tension tube pieces and a first end of a second one of said pair of coil tension tube pieces and said third first straight tube piece is connected to extend from a second end of said second one of said pair of coil tension tube pieces.

4. An upper body muscle toner device and leg and knee exerciser as recited in claim 1, wherein said U-shaped flexure member is fabricated out of a fiberglass material.

5. An upper body muscle toner device and leg and knee exerciser as recited in claim 1, wherein said U-shaped flexure member is fabricated out of a flexible metal material.

6. An upper body muscle toner device and leg and knee exerciser as recited in claim 1, wherein said U-shaped flexure member can be made in various lengths, to accommodate persons being of different sizes.

7. An upper body muscle toner device and leg and knee exerciser as recited in claim 6, further including a foam rubber insulation pipe over said elongate tube, so as to cushion said elongate tube, when the person exercises.

8. An upper body muscle toner device and leg and knee exerciser as recited in claim 7, further including a foam rubber neck brace centrally located over said foam rubber insulation pipe, so as to comfortably support the neck of the person, when the person does neck and shoulder exercises.

9. An upper body muscle toner device and leg and knee exerciser as recited in claim 8, wherein each said handgrip is a sleeve having a closed end, that slips onto a respective end of said U-shaped flexure member.

10. An upper body muscle toner device and leg and knee exerciser as recited in claim 9, wherein each said handgrip is fabricated out of a hard rubber material.

11. An upper body muscle toner device and leg and knee exerciser as recited in claim 10, wherein each said handgrip includes a textured external surface, so as to enhance holding thereof and prevent slippage of the hands of the person grasping said handgrips.

12. An upper body muscle toner device and leg and knee exerciser as recited in claim 11, further including each said handgrip having a plurality of indentations, so that the person can move their hands further up said handgrips to increase difficulty in the exercise being performed.

13. An upper body muscle toner device and leg and knee exerciser as recited in claim 8, wherein each said handgrip is extended and includes:

a) an elongate shaft having a textured external surface on a lower end, so as to enhance holding thereof and prevent slippage of the hands of the person grasping said handgrips; and b) a connector having an externally threaded shank with a collar force fit onto an upper end of said elongate shaft, so that said externally threaded shank can be threaded within one end of a bore within said elongate tube up to said collar, which will prevent said handgrip from dislodging therefrom.

14. An upper body muscle toner device and leg and knee exerciser as recited in claim 8, wherein each said handgrip is extended and includes:

a) a tube extension having a threaded shank, so that said threaded shank can be threaded within a bore at one end of said elongate tube, which will prevent said tube extension from dislodging therefrom;

b) a short shaft having a textured external surface on a lower and, so as to enhance holding thereof and prevent slippage of the hands of the person grasping said handgrips;

c) a collar formed on said short shaft and set back from an upper end; and d) adhesive applied onto said upper end of said short shaft, so that when said upper end of said short shaft is inserted into one end of a bore within said tube extension, said adhesive will prevent said short shaft from dislodging therefrom.

15. An upper body muscle toner device and leg and knee exerciser as recited in claim 14, further including a hanger assembly attached to the center of said curved tube piece, so that said hanger assembly can be utilized to hang said upper body muscle toner device and leg and knee exerciser from a support shaft when not in use.

16. An upper body muscle toner device and leg and knee exerciser as recited in claim 1, further including a foam rubber insulation pipe over said elongate tube, so as to cushion said elongate tube, when the person exercises.

17. An upper body muscle toner device and leg and knee exerciser as recited in claim 16, further including a foam rubber neck brace centrally located over said foam rubber insulation pipe so as to comfortably support the neck of the person, when the person does neck and shoulder exercises.

18. An upper body muscle toner device and leg and knee exerciser as recited in claim 1, wherein each said handgrip is a sleeve having a closed end, that slips onto a respective end of said U-shaped flexure member.

19. An upper body muscle toner device and leg and knee exerciser as recited in claim 1, wherein each said handgrip is fabricated out of a hard rubber material.

20. An upper body muscle toner device and leg and knee exerciser as recited in claim 1, wherein each said handgrip includes a textured external surface, so as to enhance holding thereof and prevent slippage of the hands of the person grasping said handgrips.

21. An upper body muscle toner device and leg and knee exerciser as recited in claim 1, further including each said handgrip having a plurality of finger indentations, so that the person can move their hands further up said handgrips to increase difficulty in the exercise being performed.

22. An upper body muscle toner device and leg and knee exerciser as recited in claim 1, wherein each said handgrip is extended and includes:

a) a tube extension having a threaded shank, so that said threaded shank can be threaded within a bore at one end of said elongate tube, which will prevent said tube extension from dislodging therefrom;

b) a short shaft having a textured external surface on a lower end, so as to enhance holding thereof and prevent slippage of the hands of the person grasping said handgrips;

c) a collar formed on said short shaft and set back from an upper end; and d) adhesive applied onto said upper end of said short shaft, so that when said upper end of said short shaft is inserted into one end of a bore within said tube extension, said adhesive will prevent said short shaft from dislodging therefrom.

23. An upper body muscle toner device and leg and knee exerciser as recited in claim 1, wherein said U-shaped flexure member includes:

a) a curved tube piece;

b) a pair of straight tube pieces; and c) a pair of springs, whereby each said spring extends between one end of said curved tube piece and one end of one said straight tube piece.

24. An upper body muscle toner device and leg and knee exerciser as recited in claim 23, further including a hanger assembly attached to the center of said curved tube pieces so that said hanger assembly can be utilized to hang said upper body muscle toner device and leg and knee exerciser from a support shaft when not in use.

25. An upper body muscle toner device and leg and knee exerciser as recited in claim 1, wherein said U-shaped flexure member includes:

a) a pair of coil tension tube pieces; and b) first, second and third straight tube pieces which interconnect with said pair of coil tension tube pieces, wherein said first straight tube piece is connected to extend from a first end of a first one of said pair of coil tension tube pieces, said second straight tube piece is connected between a second end of said first one of said pair of coil tension tube pieces and a first end of a second one of said pair of coil tension tube pieces and said third first straight tube piece is connected to extend from a second end of said second one of said pair of coil tension tube pieces.

* * * * *